US005217166A

United States Patent [19]

Schulze, deceased et al.

[11] Patent Number: 5,217,166

[45] Date of Patent: Jun. 8, 1993

[54] ROTOR NOZZLE FOR A HIGH-PRESSURE CLEANING DEVICE

[75] Inventors: Werner Schulze, deceased, late of Winnenden, Fed. Rep. of Germany; Ann Schulze, heir, Stuttgart; Astrid Schulze, heir, Detmold Klüt; Kirsten Schulze, heir, Denkendorf; Helmut Gassert, Allmersbach im Tal; Josef Schneider, Backnang, all of Fed. Rep. of Germany

[73] Assignee: Alfred Karcher GmbH & Co., Winnenden, Fed. Rep. of Germany

[21] Appl. No.: 678,359

[22] PCT Filed: Sep. 21, 1989

[86] PCT No.: PCT/EP89/01100

§ 371 Date: Jun. 19, 1991

§ 102(e) Date: Jun. 19, 1991

[87] PCT Pub. No.: WO90/04468

PCT Pub. Date: May 3, 1990

[30] Foreign Application Priority Data

Oct. 22, 1988 [DE] Fed. Rep. of Germany ..... 3836053

[51] Int. Cl.[5] ..... B05B 3/04

[52] U.S. Cl. ..... 239/227; 239/256; 239/263

[58] Field of Search ..... 239/227, 251, 256, 262, 239/263, 237, 240, DIG. 1, 263; 415/80; 416/20 R

[56] References Cited

U.S. PATENT DOCUMENTS

| | | | |
|---|---|---|---|
| 2,290,979 | 7/1942 | Luce . | |
| 2,758,874 | 8/1956 | Snyder . | |
| 2,785,926 | 3/1957 | Lataste . | |
| 4,228,559 | 10/1980 | Kirk | 415/80 |
| 4,681,260 | 7/1987 | Cochran . | |
| 4,802,628 | 2/1989 | Dautel et al. | 239/227 |
| 4,989,786 | 2/1991 | Kranzle et al. | 239/263 |

FOREIGN PATENT DOCUMENTS

| | | | |
|---|---|---|---|
| 358417 | 9/1980 | Austria . | |
| 0068097 | 1/1983 | European Pat. Off. . | |
| 0252261 | 1/1988 | European Pat. Off. . | |
| 2425475 | 12/1974 | Fed. Rep. of Germany . | |
| 8801795 | 5/1988 | Fed. Rep. of Germany . | |
| 3700587 | 7/1988 | Fed. Rep. of Germany . | |
| 3915962 | 9/1990 | Fed. Rep. of Germany | 239/240 |
| 2602987 | 2/1988 | France . | |
| 339340 | 6/1959 | Switzerland | 239/251 |
| 2152851 | 8/1985 | United Kingdom . | |
| 2155817 | 10/1987 | United Kingdom . | |

*Primary Examiner*—Gregory L. Huson
*Assistant Examiner*—Christopher G. Trainor
*Attorney, Agent, or Firm*—Barry R. Lipsitz

[57] ABSTRACT

In a rotor nozzle for a high-pressure cleaning device comprising a housing, a rotor rotatably mounted therein and set in rotation by a cleaning liquid, and a nozzle arranged downstream of the rotor with its outlet axis including a variable, acute angle with the axis of rotation of the rotor and rotated by the rotor about the axis of rotation thereof so that the jet of cleaning liquid issuing from it flows around the lateral area of a cone, to enable adjustment of the outlet angle of the point jet without having to change any other parameters, it is proposed that adjustable stops be arranged in the housing to limit to a greater or lesser extent the widening of the acute angle between the outlet axis of the nozzle and the axis of rotation of the rotor in accordance with the position of the limiting elements.

23 Claims, 2 Drawing Sheets

ROTOR NOZZLE FOR A HIGH-PRESSURE CLEANING DEVICE

Figure 1:
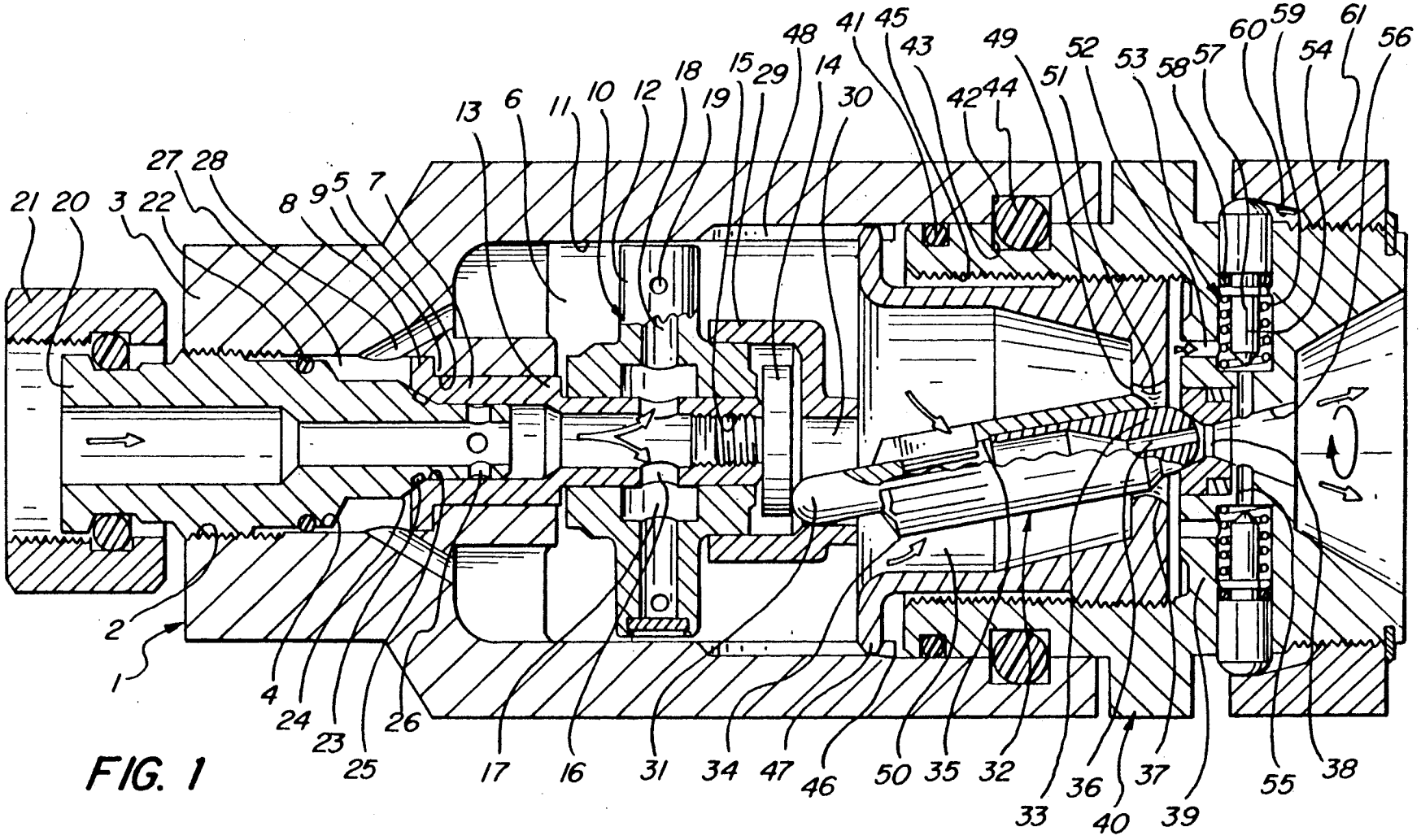

The invention relates to a rotor nozzle for a high-pressure cleaning device comprising a housing, a rotor rotatably mounted therein and set in rotation by a cleaning liquid, and a nozzle arranged downstream of the rotor with its outlet axis including a variable, acute angle with the axis of rotation of the rotor and rotated by the rotor about the axis of rotation thereof so that the jet of cleaning liquid issuing from it flows around the lateral area of a cone.

Such a rotor nozzle is known from German patent 36 23 368. With it, discharge of a point jet which flows around the lateral area of a cone is possible, and in the case of the known rotor nozzle, the angle of the lateral area of the cone can be widened as a function of the rotational speed.

The object of the invention is to further develop a generic rotor nozzle so that the operator can accurately adjust the angle of the lateral area of the cone around which the point jet flows independently of other operating parameters.

This object is accomplished in accordance with the invention with a rotor nozzle of the kind described at the beginning in that adjustable stops are arranged in the housing to limit to a greater or lesser extent the widening of the acute angle between the outlet axis of the nozzle and the axis of rotation of the rotor in accordance with the position of the limiting elements.

By adjustment of the stops it is readily possible to limit an inclined position of the nozzle and hence enlargement of the aperture angle of the lateral area of the cone. The operator can so displace these stops in the housing of the rotor nozzle that the stops then permit an inclination of the outlet axis of the nozzle which differs in extent in relation to the axis of rotation of the rotor.

In the case of a rotor nozzle with an elongated member which receives the nozzle and is supported with a spherical end in a socket which is open at the center and is held on the housing, while a follower which is connected to the rotor and is arranged at a radial spacing from the rotor axis engages the other end thereof, it is particularly advantageous for the stop to surround the elongated member concentrically with the axis of rotation of the rotor, to be adjustable in the direction of the axis of rotation of the rotor and to form a circumferential abutment edge resting on the outside of the elongated member.

Herein, provision may be made for the stop to be axially displaceably and with respect to the axis of rotation of the rotor rotationally fixedly mounted in the housing and to be screwed into a threaded bore arranged coaxially with the axis of rotation of the rotor in an adjustment sleeve which is axially immovably and with respect to the axis of rotation of the rotor freely rotatably mounted in the housing. Solely by turning this adjustment sleeve, the stop can be displaced in the axial direction inside the housing and the outlet angle of the point jet is thereby infinitely adjustable.

It is also advantageous for the follower to carry a radially extending groove in which the elongated member engages with a follower pin.

The adjustment sleeve can close off the housing at the end face thereof and carry the socket acting as bearing for the elongated member. In this way, the adjustment sleeve practically forms part of the housing, and the two housing parts are turned relative to each other about the longitudinal axis of the housing to bring about a change in the aperture angle of the jet.

In a particularly preferred embodiment, provision is made for a closable bypass pipe to issue from the interior of the housing located upstream of the nozzle into the region of the rotor nozzle located immediately downstream of the nozzle. Part of the cleaning liquid is thereby conducted past the nozzle and so the pressure of the point jet issuing from the nozzle can thereby be varied. This pressure variation is also further promoted by the quantity of liquid conducted past the nozzle in the bypass entering the point jet again in the region downstream of the nozzle and thereby breaking it up and fanning it out. In all, one thereby obtains a less sharply focused point jet with a lower issuing speed and hence with a lower impact speed.

Herein, provision may be made for the bypass pipe to comprise several bypass channels surrounding the nozzle and preferably all being of identical design.

The effect of the liquid bypassing the nozzle is particularly advantageous when the bypass pipe issues from the wall of a funnel directly adjoining the nozzle and expanding conically in the direction of flow, in particular when the bypass pipe enters the funnel essentially in a radial plane arranged perpendicular to the axis of rotation of the rotor, i.e., essentially perpendicular to the direction of the jet. Owing to the funnel-shaped walls, the quantity of liquid issuing through the bypass pipe is deflected in the direction of the point jet and carried along by it, which results in an enveloping of the sharply defined core of the point jet, which produces a substantially homogeneously fanned-out jet until it strikes a surface to be cleaned.

It is advantageous for metering valves which are adjustable in their position by adjustment members arranged on the outside of the rotor nozzle to be arranged in the bypass pipe. These enable infinite or also stepwise metering of the quantity of liquid flowing via the bypass pipe and so the operator has the possibility of adjusting the jet between a sharply focused, pure point jet and a widely fanned-out, substantially homogeneous jet.

A particularly expedient solution is achieved for adjustment of the metering valves by there being rotatably mounted on the housing concentrically with the axis of rotation of the rotor an adjustment ring carrying on the inside thereof abutment surfaces for valve bodies of the metering valves which protrude radially from the housing and are pressed elastically against the abutment surface, and by the abutment surfaces exhibiting in the region which abuts on the valve body a different radial spacing from the axis of rotation of the adjustment ring upon rotation of the adjustment ring. Hence solely by turning the adjustment ring, the bypass pipe can be opened and closed in a metered manner and so the operator can adjust in a controlled manner and without an additional tool the nature of the jet substantially continuously between a point jet and an expanded jet with a circular cross-section.

There can be provided in addition in a further preferred embodiment a closable bypass which branches off from the flow path of the cleaning liquid upstream of the rotor and leads past the rotor so that the cleaning liquid flowing through it does not participate in the rotary driving of the rotor. This makes it possible for the rotation of the rotor and, in particular, the rotational speed of the rotor to be determined by only part of the liquid while another part is conducted past the rotor. The rotational speed can thereby be influenced. Herein, it is particularly advantageous for the bypass to be closable in a metered manner as the rotational speed is in this way variable in accordance with the state of closure of the bypass.

In a preferred embodiment in which the rotor is rotatably mounted on a hollow shaft which feeds the cleaning liquid to the interior of the rotor, provision may be made for a pipe section which is mounted for axial displacement in the housing to enter the hollow shaft. In the fully pushed-in state, it is substantially sealed-off relative to the hollow shaft but on being pulled out of the hollow shaft establishes a connection between the interior of the pipe section and the bypass. Such a robust and structurally very simple assembly enables metered diversion of part of the cleaning liquid and hence also metered regulation of the rotational speed of the rotor.

Herein it has proven expedient for the pipe section to comprise lateral wall openings which are covered over by the hollow shaft when the pipe section is fully pushed in but are released from the wall of the hollow shaft when the pipe section is pulled out of the hollow shaft, and for a ring channel surrounding the pipe section to form part of the bypass. Adjustment of the pipe section is particularly simple when the pipe section is screwed into an internally threaded bore of the housing extending coaxially with the axis of rotation of the rotor. Then solely by rotation of the pipe section relative to the housing and by the ensuing axial displacement in the thread, the ratio of the amount of liquid conducted through the rotor to the amount of liquid conducted past the rotor and hence the resulting rotational speed of the rotor can be infinitely adjusted.

Figure 2:
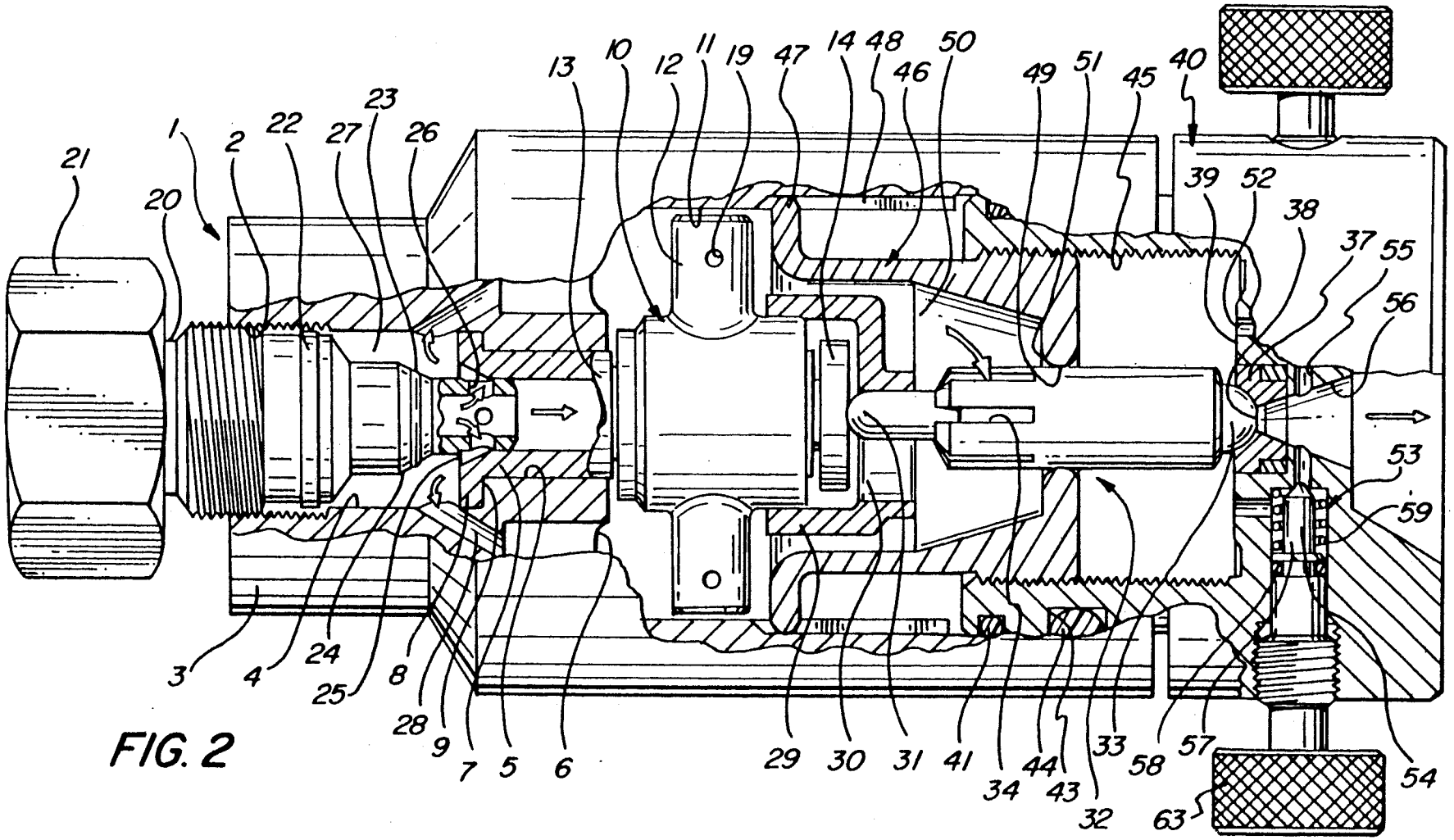

The following description of preferred embodiments serves in conjunction with the drawings to explain the invention in further detail. The drawings show:

FIG. 1 a longitudinal sectional view of a rotor nozzle with rotational speed adjustment of the rotor, angle adjustment of the nozzle and pressure adjustment of the jet at a setting for maximum rotational speed, maximum aperture angle of the point jet and with the bypass pipe open for fanning-out the point jet; and FIG. 2 a side view of a further preferred embodiment of a rotor nozzle in a partly broken-open illustration thereof with a setting for minimum rotational speed, minimum aperture angle of the jet and with the bypass pipe closed for producing a point jet which is not fanned-out.

The rotor nozzle illustrated in FIG. 1 comprises a cylindrical housing 1 which carries an internally threaded bore 2 on one side thereof and is open on the opposite side thereof. Adjoining the internally threaded bore 2 is a bore with a smooth inside wall 4 which passes into a bearing bore 5 of reduced internal diameter and finally opens into the cylindrical interior 6 of the housing 1, the internal diameter of which is substantially larger than the internal diameter of the bearing bore 5.

Inserted in the bearing bore 5 is a hollow shaft 7 which is supported with an annular flange 8 on the step 9 between the inside wall 4 of the bore 2 and the bearing bore 5 and protrudes into the interior 6 of the housing. Rotatably mounted on the part of the hollow shaft 7 protruding into the interior 6 is a rotor 10 which comprises two arms 12 protruding radially from the hollow shaft 7 and extending as far as the inside wall 11 of the interior 6. The rotor 10 is secured on the hollow shaft 7 in the axial direction, on the one hand, by a step 13 on the external circumference of the hollow shaft 7 and, on the other hand, by a screw 14 which is screwed into the free end of the hollow shaft 7 and thereby closes off the hollow shaft 7 at the end face thereof.

The hollow shaft 7 comprises at the level of the arms 12 of the rotor 10 wall openings 16 which connect the interior of the hollow shaft 7 with the interior 17 of the rotor 10 which, in turn, communicates via bores 18 in the arms 12 with outlet openings 19 at the ends of the arms 12. The outlet openings point in the circumferential direction in opposite directions and so liquid issuing through the outlet openings 19 sets the rotor on the hollow shaft 7 in rotation.

The liquid is supplied to the hollow shaft 7 via a pipe section 20 which is screwed into the internally threaded bore 2 and carries on the part protruding from the housing 1 a coupling ring for connecting it to a jet pipe of a high-pressure cleaning device, not illustrated in the drawings, and on the opposite side enters the hollow shaft 7. The pipe section 20 is sealed off relative to the smooth inside wall 4 of the bore 2 by an annular seal 22. The pipe section 20 additionally carries a further annular seal 23 in a conically tapering region of transition 24 which sealingly contacts a complementary sealing surface 25 in the region of entry into the hollow shaft 7 when the pipe section 20 is fully pushed into the hollow shaft 7. Arranged in the immediate proximity of the free end of the pipe section 20 in the wall of the pipe section are several radial openings 26 which are sealingly closed by the inside wall of the hollow shaft 7 when the pipe section 20 is fully pushed into the hollow shaft 7, as illustrated in FIG. 1.

The pipe section 20 can be turned in the internally threaded bore 2 relative to the housing 1 and thereby displaced in the axial direction until the interior of the pipe section 20 is in communication via the openings 26 with the ring channel 27 formed by the bore 2 and surrounding the pipe section 20, as illustrated in the embodiment of FIG. 2. This ring channel 27 is in direct communication with the interior 6 of the housing 1 via a number of channels 28 and so part of the liquid fed through the pipe section 20 is conducted via a bypass past the rotor 10. This bypass is formed by the openings 26 in the pipe section 20, by the ring channel 27, by the channels 28 and by the interior 6 of the housing. In the interior 6 of the housing, the liquid conducted via the bypass past the rotor is united again with the liquid which has flowed through the interior of the rotor and travelled through the outlet openings 19 into the interior 6.

By screwing the pipe section 20 more or less deeply into the housing 1, the division of the two partial flows can be varied until the entire liquid is conducted through the rotor 1 when the pipe section 20 is fully pushed-in (FIG. 1). The rotational speed of the rotor can thereby be infinitely adjusted.

Positioned on the rotor 10 is a follower 29 which engages in the form of a cap over the end of the hollow shaft 7 and the screw 14 closing the latter and has a groove or opening 30 extending radially from the center to the outside. A follower pin 31 of an elongated member 32 carrying a nozzle 33 with a spherical head enters this groove This elongated member 32 comprises lateral openings 34 which connect the interior 6 of the housing 1 with the nozzle opening 36 in the nozzle 33 via a central channel 35 in the elongated member 32.

This elongated member is supported with the spherical part of the nozzle 33 in a central bearing socket 37 which has a central opening 38 in alignment with the nozzle opening 36. The bearing socket 37 is arranged in the end face wall 39 of an adjustment sleeve 40 which enters the open end of the housing 1, thereby being sealed off by an annular seal 41, and is axially immovably and freely rotatably mounted on the housing 1. For this purpose, the housing has an annular groove 42 on its inside wall and the adjustment sleeve 40 has on its outside wall an annular groove 43 which is in alignment with the annular groove 42 and has a clamp 44 inserted in it.

The adjustment sleeve 40 comprises on the inside thereof an internal thread 45 into which a hood-shaped stop 46 is screwed. The stop 46 engages longitudinal grooves 48 on the inside wall of the interior 6 of the housing 1 by means of laterally protruding guide projections 47, whereby the hood-shaped stop 46 is axially displaceably, but rotationally fixedly mounted relative to the housing 1.

Hence when the adjustment sleeve 40 is turned relative to the housing 1, the hood-shaped stop 46 is screwed more or less deeply into the internal thread 45, i.e., the stop 46 can also be displaced between a completely screwed-in position (FIG. 1) into a position in which it is in close proximity with the rotor 10. In this position, the hood-shaped stop 46 engages over the follower 29 of the rotor 10 (FIG. 2).

At its end facing the end face wall 39 of the adjustment sleeve 40, the stop 46 is provided with an inwardly protruding stop edge 49 extending concentrically with the axis of rotation of the rotor. The stop edge 49 rests against the outside wall of the elongated member 32 and hence delimits the inclined position of the elongated member 32 relative to the axis of rotation of the rotor. In the position of the stop 46 illustrated in FIG. 1 in which it is fully screwed into the internal thread 45, a very far-reaching inclined position is possible, whereas in the extreme case illustrated in FIG. 2 where the stop is fully screwed out, an inclined position of the elongated member 32 is prevented altogether and so the outlet axis of the nozzle practically coincides with the axis of rotation of the rotor.

By turning the adjustment sleeve 40 relative to the housing 1 it is thus possible to adjust the stop 46 in the axial direction and hence the maximum aperture angle between outlet axis of the nozzle and axis of rotation of the rotor.

The hood-shaped stop 46 also forms a collecting area 50 for the liquid entering the interior 6. This collecting area 50 tapers conically in the part facing the nozzle 33 and so the liquid is fed, on the one hand, to the openings 34 in the elongated member 32 and, on the other hand, to the central opening 51 which is surrounded by the stop edge 49 and through which the elongated member 32 extends.

Several bores 52 extending parallel to the axis of rotation of the rotor and concentrically surrounding the bearing socket 37 are provided in the end face wall 39 of the adjustment sleeve 40 and open into radial bores 53 of the adjustment sleeve 40 leading from the outside inwards. These radial bores 53 first comprise a widened outer part 54 and an adjoining inner part 55 of reduced cross-section which opens into a central opening 56 in the adjustment sleeve 40 which widens outwards in the shape of a funnel and adjoins the opening 38 of the bearing socket 37. The bores 53 enter in the radial direction the opening 56 which widens in the shape of a funnel.

Valve bodies 57 displaceable in the longitudinal direction of the bores are arranged in the outer part 54 of the bores 53. These are sealed off from the bore 53 by annular seals 58 and selectively close and open the bore 53 in the region of transition between the outer part 54 and the inner part 55. In the embodiment of FIG. 1, the valve bodies 57 are pressed by helical springs 59 arranged in the outer part 54 of the bore 53 radially outwardly against an abutment surface 60 on an adjustment ring 61 which, for its part, is rotatably mounted on an external thread 62 of the adjustment sleeve 40. The abutment surface 60 exhibits different spacings from the axis of rotation of the adjustment ring 61 in the axial direction and so when the adjustment ring 61 is turned, the valve bodies 57 are pressed to different depths into the bore 53 against the action of the helical spring 59 and thereby open the flow cross-section of the bore 53 to a greater or lesser extent or close it completely when fully pushed-in. One thus obtains in each bore 53 a metering valve which is infinitely actuatable by turning the adjustment ring 61. By means of these metering valves, a partial flow can be introduced past the nozzle 33 directly into the funnel-shaped opening 56 where it mixes with the point jet issuing from the nozzle opening 36. On the one hand, the issuing speed in the point jet is reduced as the amount of liquid is decreased and, on the other hand, the quantity of liquid entering the point jet at the side breaks the point jet up and mixes with the quantity of liquid in the point jet to form a fanned-out, voluminous jet with a circular cross-section and a lower impact speed of the liquid particles. This transition can be infinitely varied by adjustment of the metering valves.

In the embodiment of FIG. 1, the bypass pipe formed by the bores 52 and 53 is open, whereas in the embodiment of FIG. 2 the metering valves are shown closed. In addition, in the embodiment of FIG. 2, in a modification of that of FIG. 1, the adjustment of the valve bodies is not carried out via an adjustment ring rotatable on the adjustment sleeve, but instead the valve bodies 57 are screwed into the outer part 54 of the bore 53 and are directly turnable via knurled discs 63 and adjustable to different insertion depths.

In all, one thereby obtains a rotor nozzle which firstly offers the possibility of adjusting the angle of the point jet issuing from the nozzle infinitely between zero and a maximum value, for example 10°. It is also possible to infinitely adjust the rotational speed of the jet by part of the liquid not being directed through the rotor but past the rotor. Finally, also the nature of the jet itself can be changed by the flow of liquid through the nozzle 33 being divided up and a quantity of liquid being transversely added to the point jet. Altogether, one thus obtains a rotor nozzle which is usable very variedly, is of robust design and in which operation of the various adjustment possibilities is simple. In the embodiment of FIG. 1, all three variations can be implemented by turning individual parts about the longitudinal axis of the housing, namely by turning the entire housing relative to the pipe connection piece fixed on the jet pipe, by turning the adjustment sleeve relative to the housing and finally by turning the adjustment ring relative to the adjustment sleeve. Herein the external design of housing, adjustment sleeve and adjustment ring is such that these are in alignment with one another and hence a cylindrical external contour can be maintained for the entire rotor nozzle.

We claim:

1. Rotor nozzle devices for a high-pressure cleaning device comprising a housing having a flow path, a rotor rotatably mounted therein and set in rotation by cleaning liquid issuing from oppositely directed openings in the rotor, and a nozzle arranged downstream of the rotor with its outlet axis forming a variable, acute angle with the axis of rotation of the rotor and rotated by the rotor about the axis of rotation thereof so that a jet of cleaning liquid flows around the lateral area of a cone, characterized in that at least one adjustable stop (46) is arranged within and mounted to the housing (1) to limit to a greater or lesser extent the widening of the acute angle between the outlet axis of the nozzle (33) and the axis of rotation of the rotor (10) in accordance with the position of the stop (46).

2. Rotor nozzle device as defined in claim 1 comprising an elongated member (32) which receives said nozzle (33) at a first end and is supported with a spherical end of said nozzle in a socket (37) which is open at the center and is held on the housing (1), while a follower (29) connected to the rotor (10) and arranged at a radial spacing from the rotor axis engages a second end of said elongated member, characterized in that the stop (46) surrounds the elongated member (32) concentrically with the axis of rotation of the rotor (10), is adjustable in the direction of the axis of rotation of the rotor (10) and forms a circumferential abutment edge (49) resting against the outside of the elongated member (32).

3. Rotor nozzle device as defined in claim 2, characterized in that the stop (46) is axially displaceable and with respect to the axis of rotation of the rotor (10) rotationally mounted in the housing (1) and is screwed into a threaded bore (45) arranged coaxially with the axis of rotation of the rotor (10) in an adjustment sleeve (40) which is axially immovable and with respect to the axis of rotation of the rotor (10) freely rotatably mounted on the housing (1).

4. Rotor nozzle device as defined in claim 3, characterized in that the follower (29) carries a groove (30) which extends in the radial direction and in which the elongated member (32) engages with a follower pin (31).

5. Rotor nozzle device as defined in claim 3, characterized in that the adjustment sleeve (40) closes off the housing (1) at an end face thereof and carries the socket (37) acting as a bearing for the elongated member (32).

6. Rotor nozzle device as defined in claim 1, characterized in that a closable bypass pipe (52, 53) couples the interior (6) of the housing (1) upstream of the nozzle (33) into the region of the rotor nozzle device located immediately downstream of the nozzle (33).

7. Rotor nozzle as defined in claim 6, characterized in that the bypass pipe (52, 53) includes several bypass channels surrounding the nozzle (33).

8. Rotor nozzle as defined in claim 6, characterized in that the bypass pipe (52, 53) issues from the wall of a funnel (56) which immediately adjoins the nozzle (33) and expands conically in the flow direction.

9. Rotor nozzle as defined in claim 8, characterized in that the bypass pipe (52, 53) enters the funnel (56) essentially in a radial plane arranged perpendicular to the axis of rotation of the rotor (10).

10. Rotor nozzle device as defined in claim 6, characterized in that metering valves (57) adjustable in their position by at least one adjustment member (61; 63) arranged on the outside of the rotor nozzle are arranged in the bypass pipe (52, 53).

11. Rotor nozzle device as defined in claim 10, characterized in that said at least one adjustment member comprises an adjustment ring (61) rotatably mounted on the housing (1) concentrically with the axis of rotation of the rotor (10), said adjustment ring (61) carries on the inside thereof abutment surfaces (60) for elastic engagement with valve bodies (57) of the metering valves that protrude radially from the housing (1), and in that when the adjustment ring (61) is turned, the abutment surfaces (60) exhibit in the area which abuts on the valve bodies (57) a different radial spacing from the axis of rotation of the adjustment ring (61).

12. Rotor nozzle device as defined in claim 1, characterized in that a closable bypass (26, 27, 28) branching off from the flow path of the cleaning liquid is provided upstream of the rotor (10) and leads past the rotor (10) so that the cleaning liquid flowing through it does not contribute towards the rotary driving of the rotor (10).

13. Rotor nozzle as defined in claim 12, characterized in that the bypass (26, 27, 28) is closable in a metered manner.

14. Rotor nozzle as defined in claim 12, wherein the rotor (10) is rotatably mounted on a hollow shaft (7) which feeds the cleaning liquid to the interior of the rotor (10), characterized in that a pipe section (20) axially displaceably mounted in the housing (1) enters the hollow shaft (7) and in the fully pushed-in state is substantially sealed-off relative to the hollow shaft (7), but on being pulled out of the hollow shaft (7) establishes a connection between the interior of the pipe section (20) and the bypass (26, 27, 28).

15. Rotor nozzle as defined in claim 14, characterized in that the pipe section (20) has side wall openings (26) which are covered by the hollow shaft (7) when the pipe section (20) is fully pushed in, but are released from the wall of the hollow shaft (7) when the pipe section (20) is pulled out of the hollow shaft (7), and in that a ring channel (27) surrounding the pipe section (20) forms part of the bypass (26, 27, 28).

16. Pipe section as defined in claim 14, characterized in that the pipe section (20) is screwed into an internally threaded bore (2) of the housing (1) extending coaxially with the axis of rotation of the rotor (10).

17. Rotor nozzle device as defined in claim 2, characterized in that a closable bypass pipe (52, 53) issues from the interior (6) of the housing (1) located upstream of the nozzle (33) into the region of the rotor nozzle device located immediately downstream of the nozzle (33).

18. Rotor nozzle device as defined in claim 3, characterized in that a closable bypass pipe (52, 53) couples the interior (6)of the housing (1) upstream of the nozzle (33) into the region of the rotor nozzle device located immediately downstream of the nozzle (33).

19. Rotor nozzle device as defined in claim 2, characterized in that a closable bypass (26, 27, 28) branching off from the flow path of the cleaning liquid is provided upstream of the rotor (10) and leads past the rotor (10) so that the cleaning liquid flowing through it does not contribute towards the rotary driving of the rotor (10).

20. Rotor nozzle device as defined in claim 3, characterized in that a closable bypass (26, 27, 28) branching off from the flow path of the cleaning liquid is provided upstream of the rotor (10) and leads past the rotor (10) so that the cleaning liquid flowing through it does not contribute towards the rotary driving of the rotor (10).

21. Rotor nozzle device as defined in claim 6, characterized in that a closable bypass (26, 27, 28) branching off from the flow path of the cleaning liquid is provided upstream of the rotor (10) and leads past the rotor (10) so that the cleaning liquid flowing through it does not contribute towards the rotary driving of the rotor (10).

22. Rotor nozzle device as defined in claim 10, characterized in that a closable bypass (26, 27, 28) branching off from the flow path of the cleaning liquid is provided upstream of the rotor (10) and leads past the rotor (10) so that the cleaning liquid flowing through it does not contribute towards the rotary driving of the rotor (10).

23. Rotor nozzle device as defined in claim 11, characterized in that a closable bypass (26, 27, 28) branching off from the flow path of the cleaning liquid is provided upstream of the rotor (10) and leads past the rotor (10) so that the cleaning liquid flowing through it does not contribute towards the rotary driving of the rotor.

* * * * *